United States Patent [19]

Tsui

[11] 4,351,171

[45] Sep. 28, 1982

[54] SEQUENTIAL LOCKING TWO KEY LOCK

[75] Inventor: Yaiman Tsui, Kowloon, Hong Kong

[73] Assignee: China National Light Industrial Products Import Export Corporation, Shantung Branch, Taingtao, China

[21] Appl. No.: 165,226

[22] Filed: Jul. 1, 1980

[51] Int. Cl.[3] ..... E05B 35/12

[52] U.S. Cl. ..... 70/339; 70/38 R

[58] Field of Search ..... 70/339, 337, 364 A, 70/38 R, 38 A, 38 B, 38 C

[56] References Cited

U.S. PATENT DOCUMENTS

| | | | |
|---|---|---|---|
| 1,565,557 | 12/1925 | Fremon | 70/339 |
| 2,667,355 | 2/1954 | Opocensky . | |
| 3,194,034 | 7/1965 | Leiser | 70/339 |
| 3,473,355 | 10/1969 | Saito . | |
| 3,916,657 | 11/1975 | Steinbach . | |

*Primary Examiner*—Robert L. Wolfe

*Attorney, Agent, or Firm*—Harvey B. Jacobson

[57] ABSTRACT

The lock includes a lock housing mounting a first tubular member. The first tubular member includes a plurality of spring biased pins which are divided into a plurality of sections. An intermediate tube is rotatably received within the first tube and includes a spring biased cam member which has a pin extending through a slot formed in the intermediate tubular member. The pin extends into the first tubular member to inhibit rotation of the intermediate tubular member. An inner tubular member is received in the intermediate tubular member and includes a keyway formed therein. A first key is received into the keyway and coacts with the first segments of each of the pins to enable rotation of the inner tubular member thereby moving the cam surface forwardly and rotating the pin to a second position. Thereafter, a second key is placed in the keyway. The second key coacts with certain segments of each pin to allow rotation of the intermediate tubular member which also carries a pair of shackle releasers.

15 Claims, 12 Drawing Figures

SEQUENTIAL LOCKING TWO KEY LOCK

BACKGROUND OF THE INVENTION

1. Field of the Invention

This invention relates to locks and especially to locks which can be opened only through the use of two separate keys.

2. Discussion of Related Art

The workings of the standard tumbler lock are now well known and such a lock can be picked with relative ease by one who possesses the right tools and a minimum of skill. Accordingly, a need has arisen for a lock which is more difficult to pick yet relatively simple in construction and operation and inexpensive to manufacture.

Various locks have been suggested which are felt to met these requirements. For instance, U.S. Pat. No. 3,473,355, issued Oct. 21, 1969 to Matsugaoka, shows a two-key lock whose bolt can be opened and closed only by using two different keys in succession. The lock includes three concentric cylinders with pin tumblers arranged in the cylinders so that one of the keys is inserted into a keyway in the innermost cylinder, the two inner cylinders rotate together 180', and when the first key is replaced by the second key, only the outermost cylinder will rotate 180°. U.S. Pat. No. 3,916,657, issued Nov. 4, 1975 to Steinbach, shows a double key axial split pin tumbler-type lock. The Steinbach lock includes a three-part plug assembly inserted in the cylinder and a plurality of tumbler assemblies carried by the plug assembly. The plug assembly includes a rear sleeve part fixed to the cylinder, a rotatable intermediate spindle part including a lock shaft extending through the sleeve part, a rotatable front drive part, and a post fixed to the drive part having means drivingly engaging a key for rotation of the drive part by turning the key. U.S. Pat. No. 2,667,785, issued Feb. 2, 1954 to Opocensky shows a two-key cylinder lock comprising a cylindrical sleeve formed with a plurality of circumferentially spaced internal seats presenting transversely opposed abutment shoulders. A key plug is rotatably mounted in the sleeve and a plurality of spring biased tumblers are carried by the plug and have ends normally projected into the seats. One of the ends is shaped to interlock with only one of the shoulders and another of the ends is shaped to interlock with only the opposite shoulder.

SUMMARY OF THE INVENTION

One object of the present invention is to provide a locking mechanism which requires sequential use of two separate keys for effecting opening of the lock.

A further object of the present invention is to provide a sequential two-key unlocking cycle or mode padlock wherein the basic principles of a pin tumbler lock mechanism are used.

An even still further object of the present invention is to provide a sequential two-key unlocking cycle or mode padlock which has a minimum number of components and can be manufactured relatively inexpensively yet is durable and effective in use.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 11, 12:
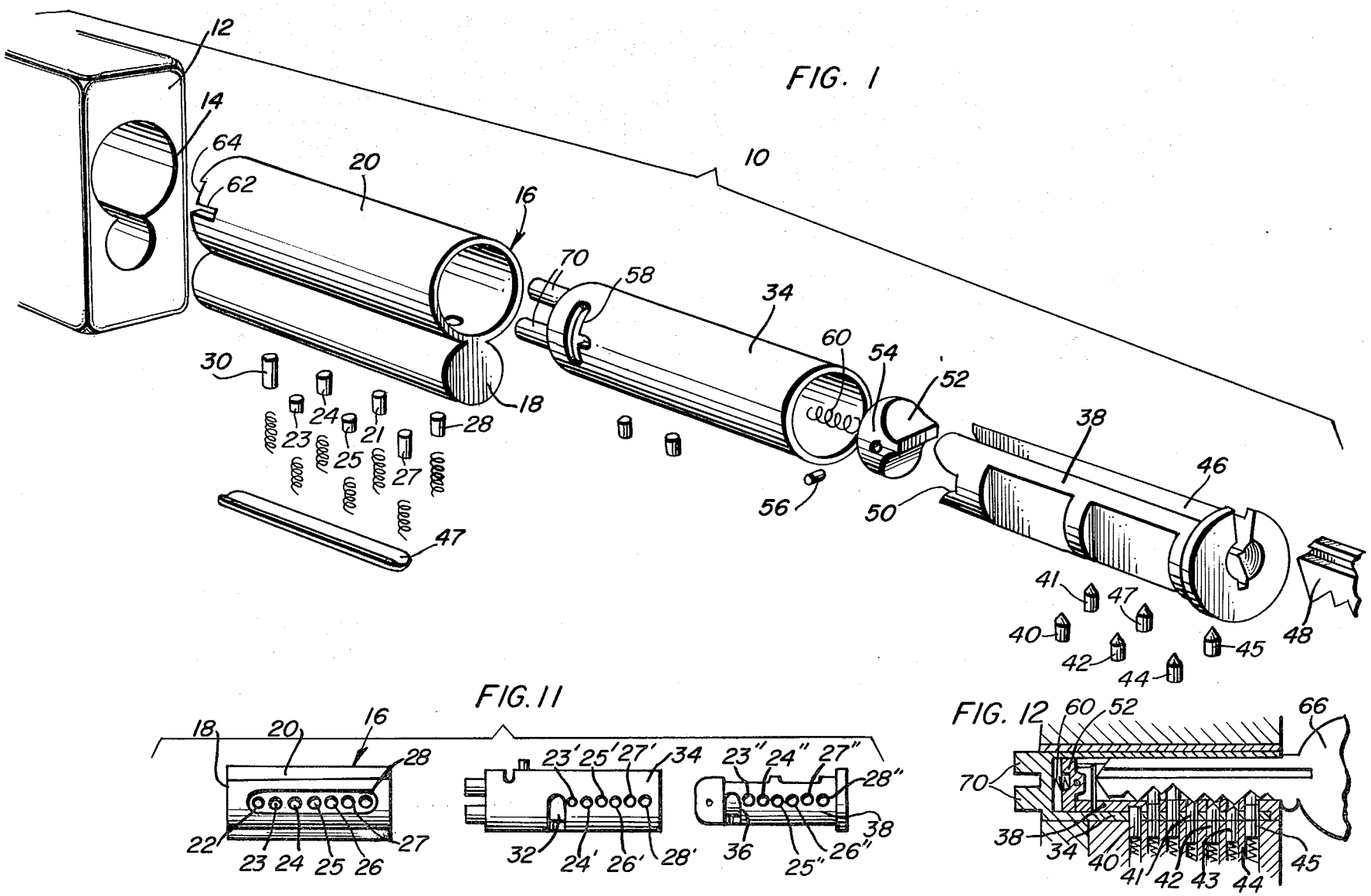
FIG. 1 is an exploded view of the two-key lock.
FIG. 11 is an exploded view of the three cylinders of the lock showing the alignment of the slots and tumbler pin openings.
FIG. 12 is a longitudinal sectional view showing the pin alignment with the second key inserted.

Now with reference to the drawings, a two key lock incorporating the principles and concepts of the present invention and generally referred to by the reference numeral 10 will be described in detail. Lock 10 includes a lock body 12 which is shown to be padlock body but could be any known device incorporating a locking structure. Body 12 has an aperture 14 formed therein to receive outer lock cylinder 16 which is held fixed within the lock body by any known means. Outer cylinder 16 actually comprises a tumbler pin mounting portion 18 and an intermediate cylinder receiving portion 20. The tumbler pin mounting portion has a plurality of radially extending holes 22 through 28. Hole 22 mounts spring biased keyway stopper pin 30 which extends through circumferential slot 32 in intermediate cylinder 34 and into groove 36 of keyway cylinder 38. Each of the holes 23 through 28 mounts a separate tumbler pin 40 through 45, respectively. Tumbler pins 40–45 are formed with either two or three sections and extend through openings 23' through 28' and 23'' through 28'' in the intermediate and keyway cylinders 34 and 38, respectively. The tumbler pins are formed with either two or three segments with the intermost segments being tapered to fit within the notches of the keys to be inserted in keyway 46 formed in cylinder 38 in a manner which is common to pin tumbler locks. Pins 30 and 40–45 are held within their respective holes together with the associated biasing springs by a curved plate 47 which is press fitted over the holes.

Figures 2, 3, 4, 5, 6, 7, 8, 9, 10:
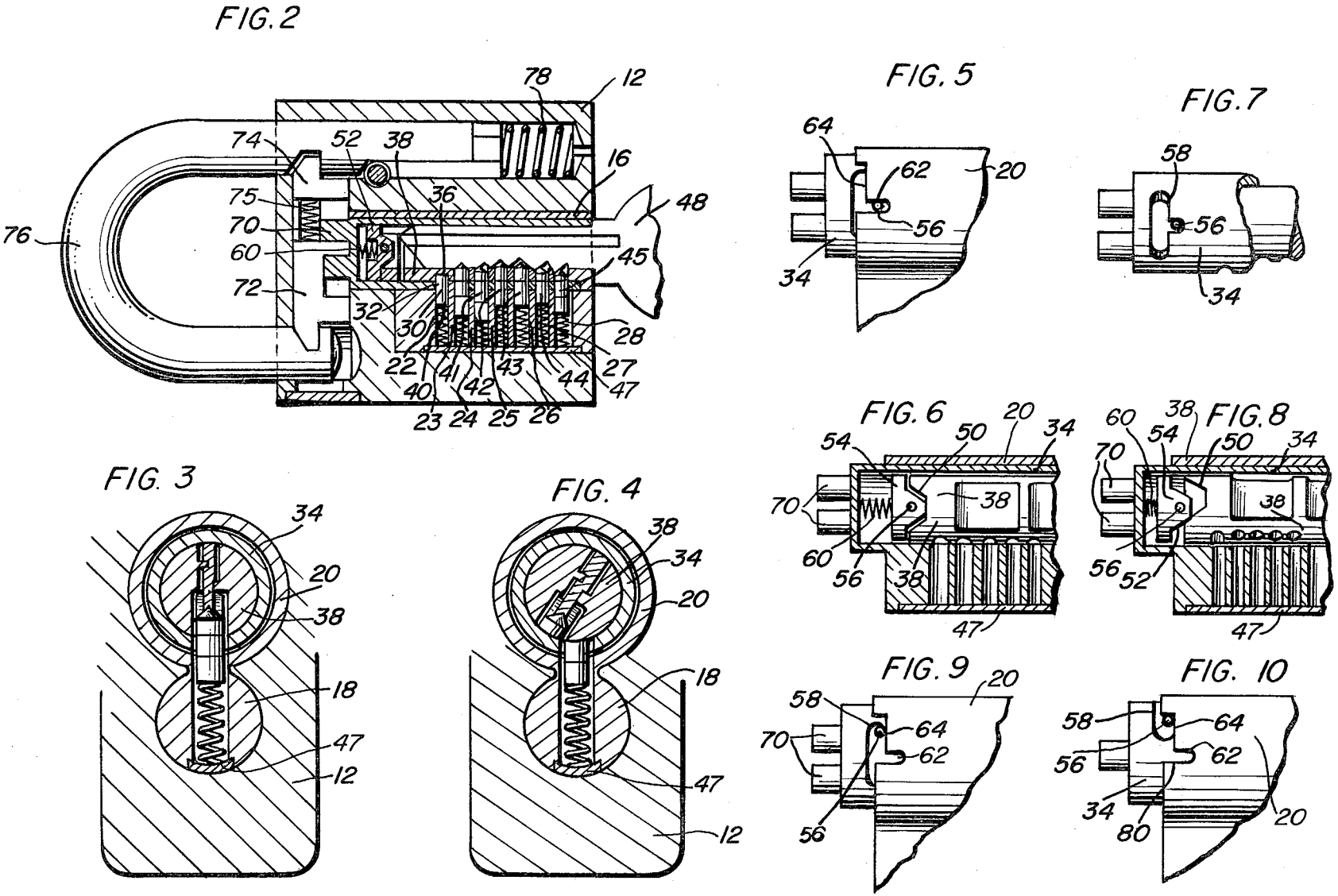
FIG. 2 is a sectional view of the two-key lock disposed in a padlock mechanism.
FIG. 3 is a sectional view showing the two-key lock in the initial position.
FIG. 4 is a sectional view showing the two key padlock with the first key turned to the second position.
FIG. 5 is a side elevational view of the outer and intermediate cylinders of the two key lock in their initial positions.
FIG. 6 is a sectional view of the outer and intermediate cylinders of the two key padlock in the position of FIG. 5.
FIG. 7 is a side elevational view demonstrating the shape of the slot in the intermediate cylinder of the two key lock.
FIG. 8 is a sectional view of the outer and intermediate cylinders of the two key lock showing the inner cylinder engaging the pin carrying cam.
FIG. 9 is a side elevational view showing the position of the intermediate cylinder with the first key turned to its second position.
FIG. 10 is a side elevational view showing the intermediate cylinder after being turned to the final position by the second key.

With the first key 48 inserted into keyway 46 as shown in FIGS. 2, 3 and 4, the first segments of pins 40–45 align with the edge of keyway cylinder 38 thus allowing that cylinder to rotate. The end of cylinder 38 contains a V-shaped cam surface 50 which receives the V-shaped cam 52 of movement regulating pin carrier or holder 54. A movement regulating pin 56 extends radially out of holder 54 and through a T-shaped slot 58 formed in intermediate cylinder 34. In the quiescent state, holder 54 is biased axially toward cam surface 50 by a spring 60 which abuts the end of the intermediate cylinder 34. Accordingly, pin 56 exends out of the axial leg of slot 58 as shown in FIG. 7 thereby inhibiting rotary motion of the pin holder. Accordingly, when keyway cylinder 38 is rotated, as shown in FIGS. 3–8, coaction of surface 50 with cam 52 causes axial movement of the pin holder 54 against the action of spring 60, thus moving pin 56 from the axial leg of T-shaped slot 58 to the circumferential head of that slot. When pin 56 extends through the axial portion of slot 58, it also extends through an axial slot 62 formed in the intermediate cylinder receiving portion 20, thus inhibiting the intermediate cylinder 34 from rotating within portion 20. Once pin 56 is moved into the circumferential portion of slot 58, it moves out of slot 62 and into recessed portion 64 thereby allowing the intermediate cylinder 34 to rotate by an amount equivalent to the extent of the circumferential portion of slot 58. Once key 48 is rotated to a point where pin 56 moves out of the axial portion of slot 58, sufficient contact between cam surface 50 and the cam 52 remains to cause the holder 54 to rotate within slot 58 and thus pin 56 will rest on recessed surface 64 as shown in FIG. 9. In this position, sufficient free play exists between the displaced holder 54 and the cam surface 50 to allow cylinder 38 to be returned to its initial position without causing return movement of the holder 54. Thus, key 48 can be removed from the keyway 16 and the second key 66 can then be inserted. Since pin 56 is now out of slot 62 and positioned into the circumferential portion of slot 58, intermediate cylinder 34 is free to rotate to the extent defined by recess 64. The only thing stopping rotation of the intermediate cylinder is the alignment of tumbler pins 41–45. Accordingly, it can easily be envisioned that the second key 66 contains key notches of sufficient depth to align the segmented portions of tumbler pins 40–45 with the outer edge of intermediate cylinder 34 as shown in FIG. 12, thus allowing that cylinder to rotate. It will be noted with reference to FIGS. 1 and 2 that certain of the tumbler pins contain two segments while others contain three segments. Accordingly, by the use of three segments, the second key can be entirely different from the first key with the outer edge of the middle segment being used to align with the outer edge of the intermediate cylinder as shown in FIG. 12 wherein it will be seen that key 66 comprises the second key used to properly align the outer end segments of pins 43–45 with the edge of the intermediate cylinder 34 to allow that cylinder to rotate within receiver portion 20. Accordingly, intermediate cylinder 34 rotates to the extent allowed by the circumferential portion of T-shaped slot 58 as seen in FIG. 10.

On the extreme end of intermediate cylinder 34 are mounted two shackle releasers 70 which, when rotated with the intermediate cylinder, cause the locking jaws 72 and 74 to move together with the bias of spring 75 thereby releasing shackle 76 which is pushed outwardly from the lock by spring 78 in a known manner.

After the shackle is released, the second key 66 is returned to the initial position to allow removal of the key from the key slot 46. In returning the key to its initial position, pin 56 abuts against wall 180 shown in FIG. 10 of the slot 62 so that when the tumbler pin segments carried by the intermediate cylinder are aligned with the remainder of the tumbler pin sections, contact of the pin 56 with wall 80 will cause the pin and pin holder 54 to rotate to the initial position, thus allowing the pin holder to snap back into the position shown in FIG. 6 with pin 56 emerging from the axial portion of slot 58. The second key 66 can then be removed and the lock readied for use again.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A locking apparatus requiring sequential actuation by two different keys for unlocking thereof, comprising:

an inner tubular member having a key slot formed therein;

an intermediate tubular member slidably receiving said inner tubular member;

an outer tubular member slidably receiving said intermediate tubular member;

a plurality of pins extending radially through said outer, intermediate and inner tubular members for contact with a key disposed in said key slot;

a cam member axially movably mounted within said intermediate tubular member;

cam surface means formed on said inner tubular member for causing axial movement of said cam member upon rotation of said inner tubular member;

a first axial slot formed in said intermediate tubular member;

a second axial slot formed in said outer tubular member, said first and second axial slots being registrable with each other; and a pin extending from said cam member through said first and second axial slots, said pin being moved from a position within said slots to a position out of said slots upon axial movement of said cam member.

2. The invention as defined in claim 1 wherein said first axial slot communicates with a circumferential slot formed in said intermediate tubular member.

3. The invention as defined in claim 2 wherein said second axial slot communicates with a recess formed in the end of said third tubular member.

4. The invention as defined in claim 1 wherein at least one of said pins is formed in three segments.

5. The invention as defined in claim 3 wherein said cam member is biased toward said inner tubular member by a spring disposed between said cam member an end wall of said intermediate tubular member.

6. The invention as defined in claim 1 wherein one segment of each of said pins is alignable with the outer edge of said inner tubular member upon insertion of a first key.

7. The invention as defined in claim 6 wherein one edge of one segment of each of said pins is alignable with the outer edge of said intermediate tubular member upon insertion of a second key.

8. The invention as defined in claim 1 wherein said cam member has a V-shaped cam surface and said inner tubular member cam surface is V-shaped to receive said cam member.

9. A locking device having an unlocking mode for release of a shackle from engagement with the locking device, the combination comprising a plurality of segmented tumbler pins; an inner tubular member having a key slot formed therein, a first key receivable in said key slot, one edge of one segment of each tumbler pin being alignable with the outer edge of said inner tubular member upon receipt of said first key in said key slot; an intermediate tubular member, a second key receivable in said key slot, one edge of one segment of each of said tumbler pins being alignable with the outer edge of said intermediate tubular member upon receipt of said second key in said key slot, said locking device having the locking mode solely comprising manually returning said released shackle into engagement with the locking device.

10. The invention as defined in claim 9 wherein each of said tumbler pins extends radially through said inner and intermediate tubular members.

11. A locking device comprising a plurality of segmented tumbler pins; an inner tubular member having a key slot formed therein, a first key receivable in said key slot, one edge of one segment of each tumbler pin being alignable with the outer edge of said inner tubular member upon receipt of said first key in said key slot; an intermediate tubular member; a second key receivable in said key slot, one edge of one segment of each of said tumbler pins being alignable with the outer edge of said intermediate tubular member upon receipt of said second key in said key slot, an outer tubular member receiving said intermediate tubular member rotatably within; first axial slot formed in said intermediate tubular member; a second axial slot formed in said outer tubular member, said first and second axial slots being registrable with each other; a pin carried within said intermediate tubular member, said pin being movable axially within said intermediate tubular member and extending through said first and second axial slots when said slots are in registration with each other; and pin movement means disposed within said intermediate tubular member upon rotation of said inner tubular member.

12. The invention as defined in claim 11 wherein said pin movement means includes a first cam surface formed on the end of said inner tubular member and a pin carrier having a second cam surface operatively engaging said cam surface on the end of said inner tubular member.

13. The invention as defined in claim 12 wherein both of said cam surfaces are V-shaped.

14. The invention as defined in claim 12 wherein first said axial slot communicates with a circumferentially extending slot formed in said intermediate tubular member, said pin being movable circumferentially in said circumferentially extending slot after being axially removed from said first axial slot.

15. The invention as defined in claim 14 wherein said pin carrier is biased axially within said intermediate tubular member towards said inner tubular member.

* * * * *